US006536704B1

(12) United States Patent
Rautakorpi et al.

(10) Patent No.: US 6,536,704 B1
(45) Date of Patent: Mar. 25, 2003

(54) METHOD AND APPARATUS FOR CONTROLLING THE REEL STRUCTURE

(75) Inventors: Timo Rautakorpi, Espoo (FI); Janne Veräjänkorva, Espoo (FI); Petri Enwald, Tuusula (FI); Teppo Kojo, Mäntsälä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/831,099

(22) PCT Filed: Nov. 4, 1999

(86) PCT No.: PCT/FI99/00921

§ 371 (c)(1),
(2), (4) Date: May 3, 2001

(87) PCT Pub. No.: WO00/26131

PCT Pub. Date: May 11, 2000

(30) Foreign Application Priority Data

Nov. 4, 1998 (FI) ..... 982390

(51) Int. Cl.[7] ..... B65H 23/02

(52) U.S. Cl. ..... 242/534; 242/534.1; 162/118; 162/283; 700/126

(58) Field of Search ..... 242/534, 534.1; 226/21, 3; 700/126; 73/37.7; 162/118–122, 283–285

(56) References Cited

U.S. PATENT DOCUMENTS 4,453,659 A * 6/1984 Torpey ..... 226/21
4,634,068 A 1/1987 Malkki et al.
4,860,964 A * 8/1989 Ishii et al. ..... 242/534.1
5,251,835 A 10/1993 Kyytsönen
5,360,179 A 11/1994 Vesterinen et al. ..... 242/526.3
5,370,327 A 12/1994 Adamski ..... 242/533.1
5,464,168 A * 11/1995 Baker et al. ..... 242/534.1
5,497,957 A * 3/1996 Hichel ..... 242/534
5,558,263 A * 9/1996 Long ..... 226/21
5,649,448 A 7/1997 Koskimies et al. ..... 73/159
5,988,557 A 11/1999 Möller et al. ..... 242/532
6,095,452 A * 8/2000 Leskinen ..... 242/534
6,363,297 B1 * 3/2002 Wienholt et al. ..... 242/534

FOREIGN PATENT DOCUMENTS

| | | |
|---|---|---|
| EP | 0739695 | 10/1996 |
| EP | 0792829 | 9/1997 |
| EP | 0839743 | 5/1998 |
| WO | 9534495 | 12/1995 |

* cited by examiner

*Primary Examiner*—John M. Jillions
(74) *Attorney, Agent, or Firm*—Steinberg & Raskin, P.C.

(57) ABSTRACT

In the method for controlling the structure of a reel, a continuous paper web (W) is reeled around a reel spool (2) to form a reel (R), and one or more variables are measured from the web (W). When a particular, predetermined change occurs in the variable, the lateral oscillation of the web is changed, by means of which the web is guided to different locations in the reel (R) in the axial direction of the reel spool (2). The change can be implemented by starting the oscillation or by changing the oscillation in progress. The change can be implemented on the basis of the changes in the transverse profile of the web (W).

28 Claims, 4 Drawing Sheets

METHOD AND APPARATUS FOR CONTROLLING THE REEL STRUCTURE

FIELD OF THE INVENTION

The invention relates to a method for controlling the reel structure, in which method a continuous paper web is reeled around a reel spool to form a reel, and one or several variables are measured from the web. The invention also relates to an apparatus for controlling the structure of the reel. The reeling in question is a continuous reeling up in which successive machine reels are formed from a paper web passed into the reel-up at the running speed (web speed).

BACKGROUND OF THE INVENTION

In the terminal end of the paper or paperboard machine or in a finishing apparatus, such as a coating machine, a continuous fibrous web passed from the preceding sections is reeled around a rotating reeling shaft (i.e. a reel spool) to form a reel, a so-called machine reel. The reeling is conducted by means of a reeling cylinder rotating at web speed, via which the web is passed on the reel. A loading is maintained between the reeling cylinder and the reel, which loading causes a particular nip load in a reeling nip located in the contact point of the reel and the reeling cylinder approximately in parallel relationship with the reeling shaft. The loading is typically implemented by loading the reel by means of a loading mechanism coupled to the ends of the reeling shaft, towards a reeling cylinder located in a fixed position in the frame of the reel-up at the same time when the reeling shaft, supported at its ends, moves further away from the reeling cylinder along with the growth of the reel. For the above-described reel-up type, the term Pope reel-up is used. In these reel-ups, it is possible to implement the rotation of the reeling shaft and the reel by means of a surface draw, wherein the reeling shaft rotates freely in the supporting structures of the reel-up, and the force required for rotation is transmitted from the reeling cylinder to the reel via the reeling nip, or by means of a centre-drive, wherein not only the reeling cylinder but also the reeling shaft is provided with a drive.

The reel-up type functioning by means of a surface draw is disclosed for example in the Finnish patent 71107 and in the corresponding U.S. Pat. No. 4,634,068. A centre-drive assisted reel-up is presented for example in the Finnish patent application 905284 and in the corresponding U.S. Pat. No. 5,251,835. A centre-drive assisted reel-up with a separate loading mechanism is disclosed in the European patent 604558 and in the corresponding U.S. Pat. No. 5,393,008.

Because continuous web is passed from the preceding sections of a paper or paperboard machine or from the finishing apparatus for the web at the running speed of the machine or apparatus, it is necessary to conduct a reel change at intervals, i.e., when the reel becomes full in the reeling station, the web is cut in a suitable manner, dependent e.g. on the grammage of the web, and the new end of the web following the cut-off point is guided around a new empty reeling shaft, which has been brought in the change station earlier from a storage of reeling shafts, i.e. a reel spool storage. There are a number of patents and patent applications related to this change sequence or a part of it, and herein it is possible to mention the Finnish patent 95683 and the corresponding international publication WO 93/34495 (member pressing the web and preventing access of air into the reel) as well as the Finnish application 915432 and the corresponding U.S. Pat. No. 5,360,179 (cutting of a web by means of a water jet) and the Finnish patent 97339 and the corresponding European application publication 739695 (striking blade cutting device for cutting of a web with a full-width cut).

The reeling cylinder typically has a fixed position in the frame of the reel-up. However, there is also a known reel-up solution, in which the reeling cylinder is arranged in the frame to move in the vertical direction and to be loaded against the reel whose position on the reeling rails is arranged adjustable. The solution, which is presented in the European patent 697006 makes it possible to move the reeling shafts along a straight path from the storage of reel spools on the reeling rails over the top of the reeling cylinder, and enables a fixed position of the reeling shaft during the reeling by compensating the growth of the reel with a downward motion of the reeling cylinder. The European application publication 792829 discloses a reel in which the reeling cylinder to be loaded against the reel is able to move in the horizontal direction when the size of the reel grows and the reeling shaft rotates in its position.

Consequently, there are a number of known reel-up concepts. It is common to all aforementioned reel-up concepts that they comprise a reeling cylinder with a fixed position or a moving reeling cylinder, as well as a growing machine reel which is in nip contact with the same. A common feature to all reel-up concepts is an accurate and demanding change sequence implemented by means of an empty reeling shaft brought in contact with the same. A disturbance-free change sequence with the purpose of avoiding broke, sets high demands on the actuators and on the automation. At present, especially the high web speeds, which normally exceed 20 m/s, generally already 25 m/s, set demands for a disturbance-free function of the reel-up so that it would be possible to obtain machine reels which are as flawless as possible.

During the reeling that takes place in the reeling station itself, the aim is to affect the structure of the reel to be produced by means of the linear pressure (linear load) effective in the reeling nip. According to present-day knowledge, the reeling result of the reel-up clearly correlates with the transverse profiles of the web to be reeled. It has been observed that a particularly problematic profile is a "smiling" or a "cup-like" transverse profile of the thickness, which, on the basis of calculations, is known to cause rising edges also in the shape of radial pressure distribution graph inside the reel.

According to a theory, a web whose edges are thicker than the central part, produces forces inside the machine reel which can cause inner movements. As a result of the movements, the core of the machine reel can stick out, which causes bottom or edge cracks.

The web is passed on the reel via a reeling nip, in which nip the radius of the reel can be rendered smaller than average (the reel is compressed slightly), and thus it is possible to affect the compression of the reel in the nip, in other words the radial difference, which produces a suitable/desired tight reeling on the reel. Especially when paper is reeled which has been processed with a so-called multi-roll calender in which paper is passed via several nips and in which the linear loads are very high, even of the order of 400 kN/m, new requirements are set for the reeling. Because it is not typically possible to use linear loads which are even close to this order in the reeling, but they are approximately max. 6 kN/m, the radius of the reel does not change significantly in the reeling nip, and thus, the formation of the reel has to be conducted in a centre-drive assisted manner in association with passing of the paper on the reel via the nip, wherein the air is controlled by means of the nip, and the centre-drive is utilized to set the tension of the web on the reel.

Thus, in connection with a multi-roll calendered paper the situation is somewhat different than when reeling uncalendered paper; in the reel-up the applicable area of the linear load can be even 50 times smaller than the linear load used in the multi-nip calender. At the reel-up the web pressed once with a great force is run through a nip load which is 50 times smaller, and thus, the effect on the paper is no longer significant. Especially in this kind of a process, the variations in the thickness will become pronounced in the formation of the reel.

The transverse profiles of the web are produced by means of the paper machine and the finishing apparatuses before the reeling up process. As an example of an adjustment conducted by means of the paper machine or the finishing apparatus for paper, it is possible to mention the U.S. Pat. No. 5,649,448. It is not possible for the reel-up to affect the properties of the web, but the last point in which the properties of the paper are affected is calendering. On the other hand, by means of the reel-up, it should be possible to reel a machine reel even from a web which has a poor transverse profile, without defects or losses of material produced by the reeling. Along with the running speeds, the aim is to increase the size of the machine reels reeled in the reel-up. When the diameter of the reel grows, also the requirements for a homogenous quality of the web are increased.

OBJECTS AND SUMMARY OF THE INVENTION

It is an object of the invention to eliminate the drawbacks due to prior art reeling processes, and to introduce a method by means of which the flaws in the quality of the reels to be reeled can be reduced. To attain this purpose, the method according to the invention is primarily characterized in that when a particular, predetermined change occurs in the variable, the lateral oscillation of the web is changed, by means of which the web is guided to different locations in the reel in the axial direction of the reel spool.

It is another object of the invention to improve the reeling result by using the oscillation of the web as an active manipulated variable. When a change is detected in the measurement conducted on the web, the oscillation, by means of which the web is guided on different points of the reel in the axial direction of the reel spool, is changed. The change in the oscillation can be such that the oscillation amplitude is normally zero, i.e. it is non-existent, and the oscillation is initiated when a change is detected in the variable measured from the web in the measuring point measuring the properties of the web, which change has an impairing effect on the quality of the reel. The measurement, on the basis of which the oscillation is determined, can be the measurement of the transverse profile of the web at a suitable point in the travel path of the web by means of a suitable method. The act of starting the oscillation of the web as well as the amount of oscillation can be dependent on the quality of the transverse profiles. The invention can be implemented in such a way that when the dispersion in the measurement of thickness or another variable describing the irregularity of the transverse profile exceeds a particular threshold value, the oscillation begins. The change of the oscillation can also be performed when the oscillation is on. The quantitative adjustment of the oscillation can be implemented in such a way that when a dispersion in the on-line thickness measurement of the web or another variable correlating with the irregularity of the transverse profile grows, the amplitude and/or speed of the oscillation is increased. When taken a step further, the adjustment can also take into account the shape of the profile, wherein the amplitude and/or speed of the oscillation could be adjusted on the basis of the same.

BRIEF DESCRIPTION OF THE DRAWINGS

In the following, the invention will be described with reference to the appended drawings, in which.

DETAILED DESCRIPTION OF THE INVENTION

Figure 1:
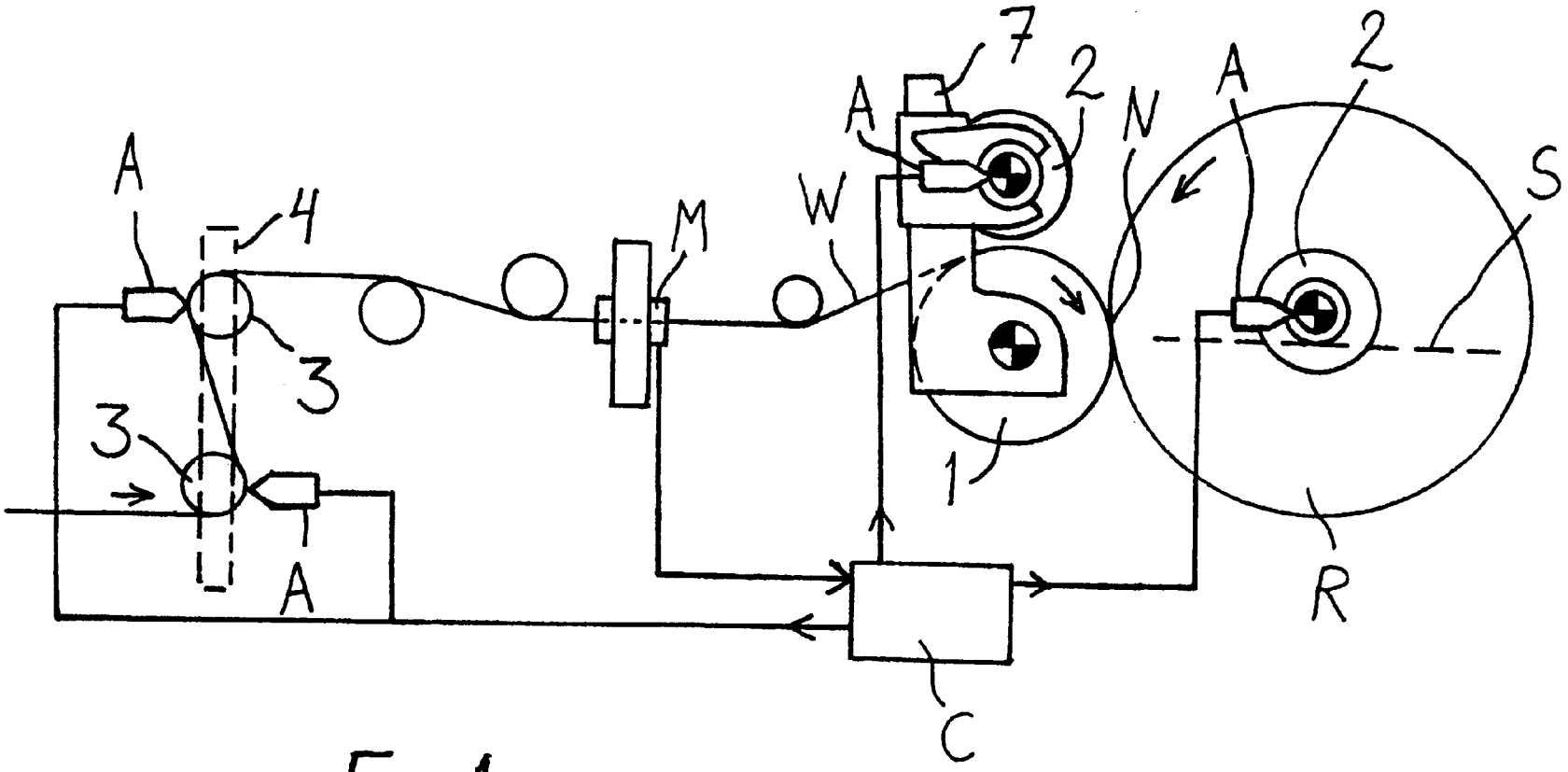
FIG. 1 shows a side-view of a reel-up and the parts preceding the same and the alternatives of the method according to the invention are shown schematically therein.

FIG. 1 shows a reel-up which is arranged to reel a continuous web W running at a particular web speed in the terminal end of a paper or paperboard machine or a finishing apparatus for paper or paperboard. Before the reel-up, the web is calendered with a known method by passing it through at least one calendering nip, wherein a greater nip load is exerted on the web in the calender, for example a nip load 10 times greater than the nip load in the reel-up. The reel-up comprises a reeling cylinder 1 arranged rotatable by means of a drive, over which reeling cylinder 1 the web W travels within a certain sector to the reel R and around a reeling shaft i.e. reel spool 2 rotating in a supporting structure, via a nip N between the reeling cylinder 1 and the reel R. There is a particular linear load prevailing in the reeling nip as a result of the fact that the reeling cylinder 1 and the reel R are loaded against each other with a particular force. This can be attained in a known manner by loading the reel spool 2 towards the reeling cylinder 1 by means of a loading mechanism coupled to its ends, or also by loading the reeling cylinder 1 against the reel R. The reeling nip N is utilized to control air, but the properties of the paper cannot be affected by the same any more.

The supporting structures of the reel spool 2 can be reeling rails along which the ends of the reeling shaft move during the reeling, or a reeling carriage which receives the weight of the entire reel and can be moved by means of suitable motion means in accordance with the growth of the reel, for example along a path of motion in the direction of the horizontal plane. These structures are schematically marked with a broken line S in FIG. 1. The supporting structures S constitute a reeling station in which most of the reel is formed, and in which the reel becomes full before reel change. The reel spool 2 is rotated with a drive of its own, i.e. the reeling is centre-assisted.

Before the reel-up, the transverse profile of the web is measured in a suitable manner, advantageously by means of a measuring device M for the transverse profile of the grammage or the transverse profile of the thickness, the measuring device M being located after the drying section and measuring the transverse profile continuously from the web passing by. The measuring device can be for example a known traversing device attached in a transverse measuring beam and arranged to transmit measuring signals in electrical form to the processing of results. The measurement signals travel to a central processing unit C which is arranged to control actuators A which produce the oscillation, i.e. the guidance of the web in the lateral direction in different points on the reel, wherein it is possible to avoid "cumulation" of the profile in the reel, for example a radial pressure distribution with rising edges, due to a thicker-edged profile. FIG. 1 shows different points in which the actuators A can be arranged to move the web W and the reel spool 2 transversely with respect to each other. It is possible to effect a transverse, reciprocating motion in the web before the reel-up, especially by means of special members 3 guiding the web, or the reel spool 2 itself can be moved back and forth in the reel-up in the reeling station and/or in the initial reeling device 7, while the web remains in the same point, and consequently it is not necessary to arrange special members before the reel-up to guide and transfer the web.

It is also possible to conduct a measurement from the web on the reel. It is, for example, possible to take into account the transverse profile of the diameter and/or hardness and/or density of the reel R that has been already formed, as well as to control the oscillation on the basis of this information.

In its simplest form, the invention is implemented in such a way that when the measurement result fulfils certain predetermined conditions, for example a parameter of the transverse profile or a measurement result which otherwise correlates with the unevenness exceeds a predetermined threshold value, which can be for example a predetermined allowed maximum deviation when the entire width of the web is taken into account, a particular maximum deviation in a particular area of width in the web, for example in the edge area, statistical dispersion in the transverse profile in the entire width of the web or statistical dispersion in the transverse profile in a particular area unit of the width, for example in the edge area of the web, or a shape of a particular quality in the profile, the central processing unit C gives a message to the actuators A to start the oscillation.

According to another alternative, when the aforementioned parameters or measurement results change, also the oscillation is changed. For example when the profile changes on the basis of the received information to a less advantageous direction, the amplitude and/or speed (frequency) of the oscillation is changed. Similarly, it is possible to measure and register the profile shapes continuously, and to increase the amplitude and/or speed when the shape changes to a less advantageous one.

The oscillation has a particular maximum amplitude which is dependent on the oscillation mechanism or is otherwise restricted. The maximum value of the amplitude can be dependent for example on the maximum motional stroke of the actuators producing the oscillation. The speed of oscillation i.e. the frequency, in turn, can be rendered dependent on the running speed of the machine. It can be directly proportional thereto. Each running speed of the machine can have a particular frequency in a manner described hereinbelow.

The amplitude of the oscillation in the axial direction of the reel spool is typically max. 100 mm, advantageously between 2 and 50 mm. To maintain a good structure of the reel, the oscillation must not be too drastic. The maximum oscillation frequency is advantageously such that during one cycle a web length of at least 100 m, advantageously at least 200 m is reeled on the reel. For example at running speeds of 25 m/s the length of 100 m signifies a frequency of 0.25 Hz (1 cycle/4 seconds). The minimum frequencies and the optimum frequencies can be determined in a corresponding way in metres.

It is possible that at a particular moment, as a result of the measured information, the profile is such that the oscillation occurs with the maximum amplitude (for example within the limits of the maximum motional stroke of the actuators). When the situation improves, the next step is to start a shorter oscillation, i.e. oscillation with a smaller amplitude. Similarly, it is possible move the area of influence of the amplitude of the oscillation, i.e. when oscillation is effected with an amplitude smaller than the maximum amplitude, it is possible to change the location of the extreme points of the oscillation in the lateral direction. Thus, in a way, a transition "aside" from the preceding point takes place, wherein the amplitude of the oscillation can also remain the same.

By means of the oscillation, it is possible to avoid the disadvantages of all profiles that rise towards the edges from the middle. According to corresponding principles, the oscillation can be started and its amplitude can be increased also with profiles of other types, also in case of profiles which rise towards the middle from the edges, or in case of profiles in which the deviations are more irregular and the profile is closer to a wave-like shape, or it is irregular, comprising sporadic peaks at random places. Naturally, there are a number of mathematical methods and algorithms to be used for estimating the quality of the profile as well as the extent of the variations, which can be programmed in the central processing unit C beforehand to start and adjust the oscillation on the basis of the results of the calculations.

When the measurement result of the web no longer fulfils the oscillation conditions, i.e. the measurement or calculation result of the web lies within acceptable limits again, the oscillation is terminated by a command from the central processing unit C.

Figure 2:
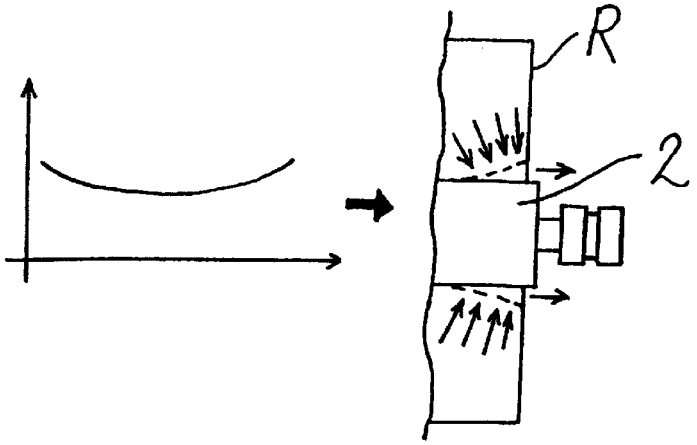
FIG. 2 shows a typical transverse profile of the web and a problem caused by the same in the reel.

For example FIG. 2 shows a typical transverse profile of the thickness of the web, in which the web is thicker on the edges than in the middle. It is shown on the right-hand side of the drawing how the thicker edge part causes forces inside the machine reel which generate inner movements in the direction of the axis of the reel spool 2, which movements can cause the core of the reel to move out.

Figure 3:
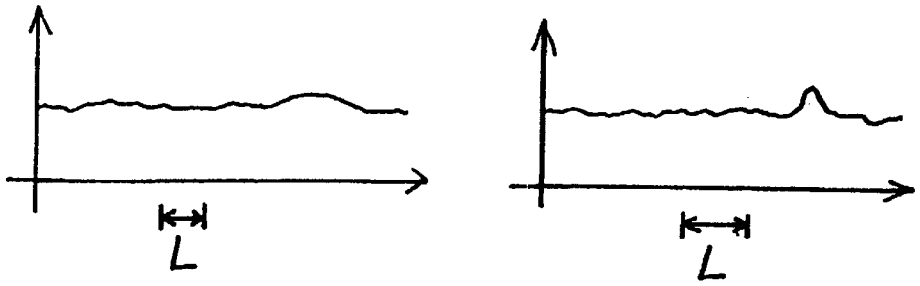
FIG. 3 shows two transverse profiles and oscillation implemented in connection with the same.

FIG. 3 is an example showing how the quality of the profile can affect the oscillation. The left-hand side shows a thickness profile with a low, wide, peak. This does not disturb the web to a great extent, and in this case a small oscillation amplitude L is sufficient. On the right-hand side, in turn, there is a steep, narrow peak. The effect of this peak has to be distributed on a wider area, and thus the amplitude L is greater. With the measuring device M it is thus possible to detect for example the maximum deviation and calculate its magnitude from the mean value in the central processing unit C. Thus, the magnitude of the deviation can be proportional to the extent of the amplitude L, e.g. as defined by a suitable algorithm. Instead of the peaks, the deviations can also be pits, and they can be processed in a corresponding manner. As can be seen in FIG. 3, the deviations can come up sporadically in the area between the edges of the web, and they are not necessary located on the outer edges of the web.

Figure 4:
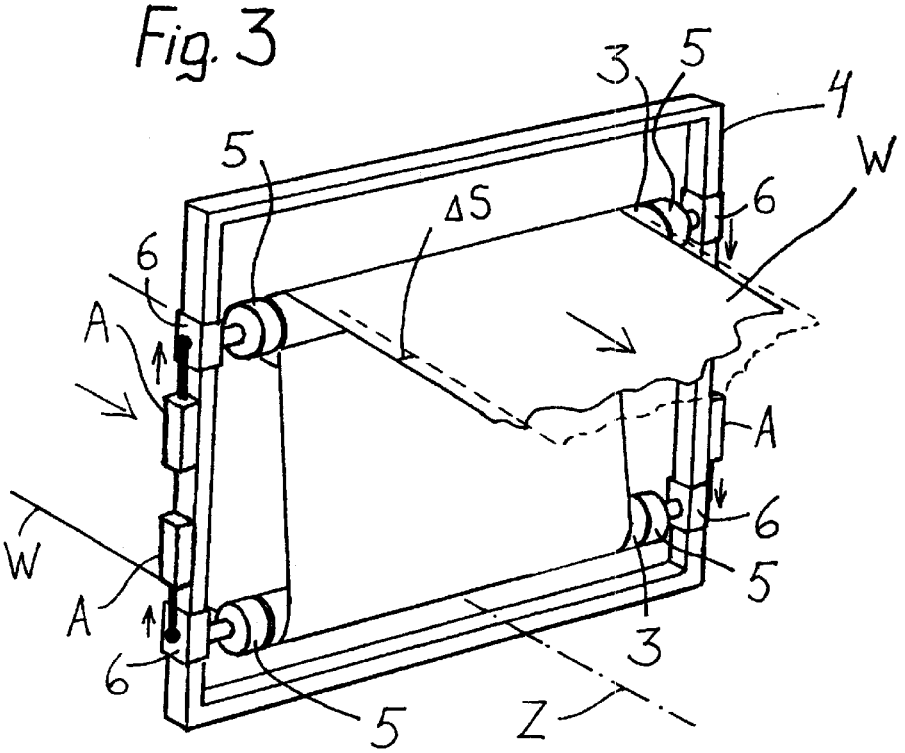
FIG. 4 shows a possibility to implement the oscillation before the reel-up.

FIG. 4 illustrates a possibility to implement the oscillation in the point of location before the reel-up shown in FIG. 1, with the purpose of guiding the web W in different locations in the axial direction of the reel spool 2 in a manner determined by the amplitude of the oscillation. The web W is guided by means of two guiding members 3, such as rolls, the web changing its direction at the point of location of both of them. The web W can be passed to a lower member in the machine direction, from which it is directed upwards to an upper member 3, and thereafter further on towards the reel-up in the longitudinal direction of the paper machine. The axes of the members 3, which are perpendicular to the travel direction of the web, are subjected to a reciprocating rocking motion, which generates oscillation in the lateral direction of the web, i.e. a movement of the web transversely in different locations. In FIG. 4, to attain the rocking motion of both members 3, the rolls are arranged rotatable in the frame structure 4, and the bearing arrangements 5 on the ends of the rolls are arranged in the frame structure 4 so that they can be moved back and forth. The end bearings of the rolls can be attached to supports 6 which are arranged to move up and down in vertical guides located on both sides of the frame structure 4 by means of suitable actuators A. The members 3 are turned by means of the actuators A in such a way that together they effect a rocking motion in the entrance point of the web W around the central line Z of the web travelling via the tangent point of the web and the first roll 3. The second roll 3 turns in a synchronized manner with respect to this line Z, and thus a side shift or offset ΔS from the middle position which is half of the amplitude L of the oscillation is attained in the web passed from the second roll 3. The rolls turn back and forth between the extreme positions on both sides of the middle position, and their movement is synchronized in the above-described manner. According to another alternative, the rolls 3 can be turned back and forth by turning the common frame structure 4 supporting the same around said line Z, wherein the ends of the rolls do not have to be moved in the frame structure. Thus, an advantage is a simpler structure, but then the heavier frame structure must be moved in a corresponding manner.

The rolls can be journalled rotatable, but the oscillation is attained by means of other elongated members guiding the web, which members are located transversely to the longitudinal direction of the web and guide the travel of the web, the turning motion of which members shifts the web in different locations in the lateral direction. The rolls can be non-rotating, wherein the web can be arranged to glide over the surfaces, especially at web speeds of over 500 n/min. Thus, the surface material of the roll can be selected so that it has the suitable properties. It is obvious that if the members in question are non-rotating, the members do not have to have a circular cross-section, but it is sufficient that they comprise curved surfaces guiding the travel of the web. Such members can be equipped with apertures opening in the surface guiding the web, from which apertures air is blown, for which purpose pressurized air is introduced inside the member.

Figure 5:
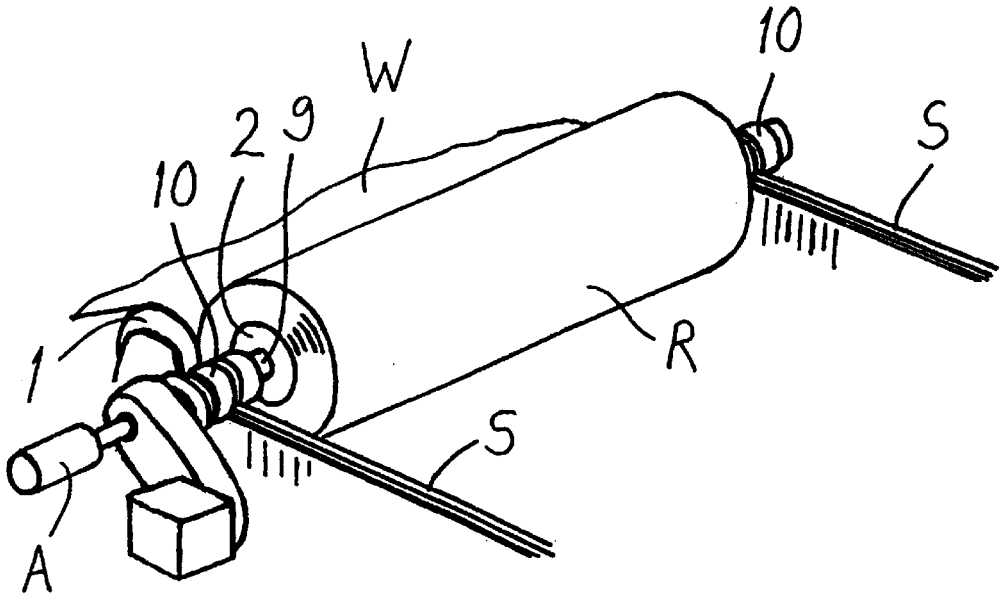
FIG. 5 illustrates the implementation of the oscillation in the reel-up.

FIG. 5 shows an alternative for the method of FIG. 4. Here, the oscillation is implemented by means of actuators located in the reel-up, which actuators are controlled by the central processing unit C according to the above-described principle. The actuator A acts on the end of the reel spool 2 in such a way that the reel spool moves in the lateral direction with respect to the reeling cylinder 1, wherein the movement is linear and reciprocating, and the length of motion thus determines the oscillation amplitude. The ends of the reel spool 2 are supported on the supporting structures S, which in the drawing are reeling rails, and it is possible to arrange the reel spool together with the reel R to move with respect to the supporting structure. Principally, it would be possible to move the entire supporting structure in the transverse direction, wherein the reel spool 2 and the reel R move transversely to attain oscillation, which, however, requires changes in the frame structures of the reel-up. In order to avoid having to move the heavy supporting structures, it is advantageous to arrange the reel spool 2 to move by means of the actuator A effecting a reciprocating motion therein, wherein the actuator can be coupled e.g. to the existing devices, such as known centre-drives connected to the end of the reel spool 2 in a rotating motion transmitting manner making the reel spool to rotate during the reeling. In FIG. 5, the actuator A is located as an extension to the rotating shaft, and it is arranged to transmit reciprocating motion to the driving shaft in such a way that the rotating motion can be simultaneously applied to the driving shaft by means of a suitable power transmission.

Figure 6:
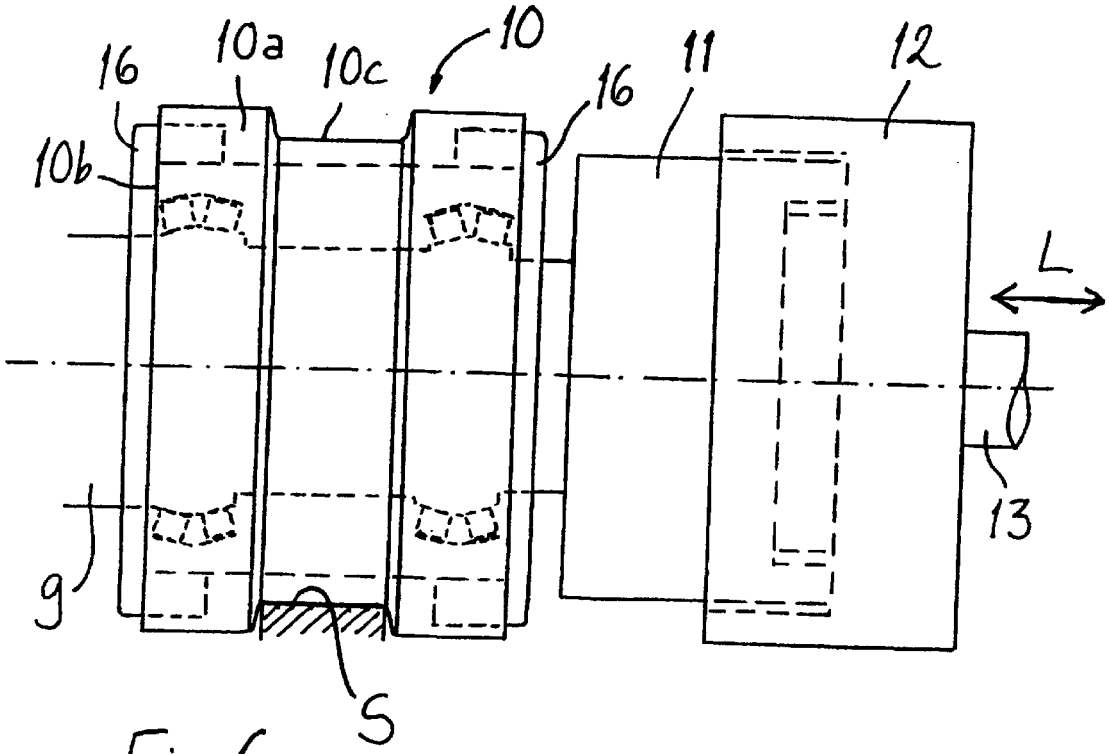
FIG. 6 shows the arrangement of FIG. 5 in a reeling station.

FIG. 6 shows the manner of FIG. 5 to implement the axial reciprocating motion of the reel spool 2 in the machine direction. The drawing shows a bearing housing 10, which rests on top of a supporting structure supporting the reel R in the reel-up, through which a rotating shaft 9 is led, the reel spool 2 being rotated via the rotating shaft 9 during the reeling. The outer part of the bearing housing 10 is composed of an external sleeve 10*a,* which remains stationary in the supporting structure, and an inner part 10*b* which is arranged inside to slide with respect to the same, enclosing the bearing arrangement of the rotating shaft 9 of the reel spool, is capable of moving back and forth in the axial direction of the reel spool, and thus the reel spool 2 is allowed to move sideways with respect to the supporting structure of the reel-up within an amplitude corresponding to the oscillation amplitude L. The cover plates 16 which are located at the ends of the bearing housing and attached to the inner part 10*b,* are allowed to move in recesses located at the ends of the outer sleeve 10*a,* which recess can be provided with guide pins and springs. Outside the bearing housing 10, at the end of the rotating shaft 9, there is a connecting part 11, to which a connector 12 of the centre-drive is connected in such a manner that it transmits rotating motion, said connector being located at the end of a driving shaft 13 connected to a power source. Thus, the driving shaft 13 transmits to the reel spool 2 both the rotating motion and the axial oscillation motion. To transmit the reciprocating motion to the reel spool, the joint between the connector 12 and the connecting part 11 is also locked in the axial direction. The rotating motion can be transmitted to a recess at the end of the connecting part 11 by means of a toothed transmission. Motion in the axial direction is possible for example by arranging an outer part in the connector 12 of the centre-drive, which outer part extends around the outer perimeter of the connecting part 11, wherein the joint can function with a pressing locking (for example friction which is obtained between the surfaces by means of a member adjustable with a pressurized medium) or a mechanical locking based on shape.

Figure 7:
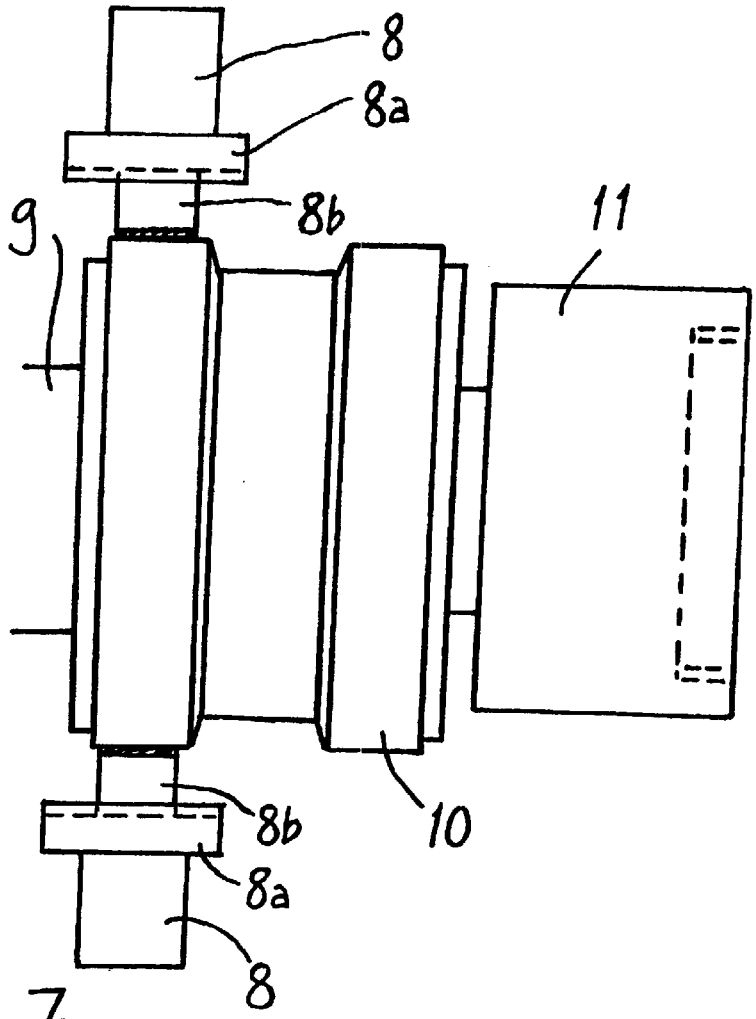
FIG. 7 shows the arrangement of FIG. 5 in an initial reeling device.

FIG. 7 shows another alternative structure. Here, the oscillation possibility is provided in the initial reeling device 7, which comprises primary arms supporting the ends of the reel spool and transferring the reel spool and the reel formed around the same in a known manner during the initial reeling along the perimeter of the reeling cylinder 1 to the actual reeling station onto the support of the supporting structures S. The principle is the same as the one in the actual reeling station, i.e. a reciprocating axial motion is effected in the reel spool by means of an external actuator A. The jaws of the primary arms which receive the end of the empty reel spool between them at the location of the bearing housing 10 when the reel spool is moved in the reel-up, are marked with the reference numeral 8. The reel spool 2 is capable of moving in the axial direction during the initial reeling as a result of the fact that the guiding pieces 8*a* attached to the jaws are provided with slide bodies 8*b* pressed with a sufficiently efficient friction on the outer surface of the bearing housing 10, said slide bodies moving together with the bearing housing 10 and the reel spool 2 in the axial direction with respect to the guiding pieces 8*a,* wherein the piece 8*a* is provided with a guide or the like which guides the slide body 8*b* in the axial direction. Thus, it is not necessary for the rotating shaft 9 to move in the axial direction with respect to the bearing housing 10, because the possibility for motion exists between the bearing housing 10 and the jaws 8. The reciprocating motion can be transmitted to the rotating shaft 9 in a manner corresponding to the principle of FIG. 6 by the connecting part 11, by means of which the reel spool 2 is rotated in the initial reeling device 7. If the bearing housing 10 structure is composed of two parts in accordance with the principle of FIG. 6, the bearing housing 10 can remain stationary between the jaws 8, and the oscillation is conducted in a similar manner as shown in FIG. 1. Thus, the oscillation is possible both during the initial reeling and during the reeling conducted in the reeling station, if this is necessary on the basis of the measurement information obtained from the paper web W.

Figure 8:
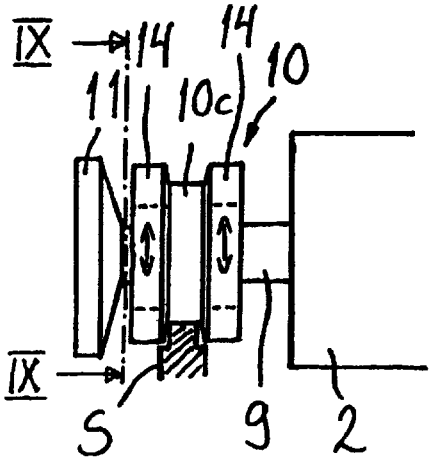
FIGS. 8 and 9 show a preferred alternative for the structure of the end of the reel spool.

Furthermore, FIG. 8 shows an advantageous structure of the reel spool 2, seen in the machine direction, which structure can be used whether the oscillation is in progress or not. In this solution, the surface receiving the loading effecting the linear load in the reeling nip N, and the rolling surface which is in a supporting contact with the supporting structures, are separated from each other in such a way that the aforementioned surfaces are journalled rotatable with respect to each other in the direction of rotation of the reel spool 2. The central part 10*c* of the bearing housing 10 is provided with a recess extending in the peripheral direction, the cross-section of the recess perpendicular to the axial direction having a circular shape, the recess being intended to rest on a rail or a corresponding supporting structure or to roll along with the same when the size of the reel grows. The surfaces 14 receiving the loading appear in a ring-like shape on both sides of the recess of the central part 10*c,* and these ring-like parts rotate with respect to the part 10*c,* which is in rolling contact with the supporting structure S. Thus, it is possible to eliminate the rolling of the bearing housing 10 in the supporting structure S as well as the loading of the bearing housing 10 for the nip linear load through the same kinetically unitary surface.

If a failure occurs for example in the loading contact of a loading structure, such as a force device, or a loading mechanism attached thereto, the friction force between the bearing housing 10 and the loading structure is increased, and it may hamper the rolling of the bearing housing on the supporting structure, if the outer surface of the bearing housing both at the location of the loading contact and the supporting structure consists of the same solid body. Thus, the bearing housing 10 may slide on the supporting structure S and the linear load will be increased to a high value in the nip N. In the structure of FIG. 8, the disturbances in the loading contact occur between the surface 14 and the loading structure, and thus they do not affect the rolling contact of the bearing housing 10 with the supporting structure. The loading can be arranged through the bearing housing in such a way that a loading contact is exerted on the outermost ring-like surface 14 in the reeling station, and a loading contact effected by the initial reeling device is effected on the inner, ring-like surface 14 located on the other side of the recess. It is obvious that the structure according to FIG. 8 is provided on both ends of the reel spool 2.

Figure 9:
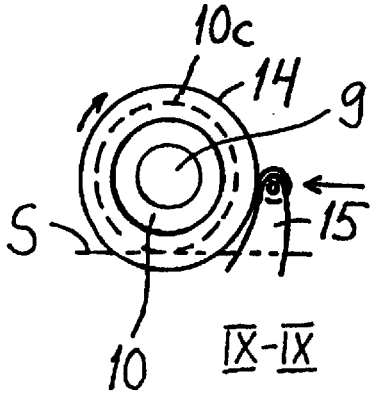

FIG. 9 shows a corresponding differentiated structure of the bearing housing 10, seen from the end of the reel spool 2. The loading structure which is in a loading contact with the surface 14 for example via a roller, is marked with the reference number 15.

The surfaces 14 can be journalled to rotate with respect to the rest of the bearing housing 10. Similarly, the central part 10*c* can be journalled rotatable with respect to the rest of the bearing housing, wherein the surfaces 14 may be kinetically composed of the same surface. If the reel spool 2 in question is a reel spool the structure of which also enables oscillation, the surfaces 14 receiving the loading can be arranged to rotate with respect to the outer part i.e. the outer sleeve 10*a*.

The surfaces 14 and the central part 10*c* can all be mounted rotatively around the rotating shaft 9 of the reel spool, wherein they also rotate with respect to each other.

Furthermore, it is possible that only one of the surfaces 14 receiving the loading is arranged to rotate with respect to the central part 10*c* which is in rolling contact with the supporting structure S, and the other surface 14 is kinetically the same surface with the part 10*c*.

It is also possible that a surface receiving the loading is located elsewhere than in the area of the bearing housing 10. Thus, it can be independently mounted rotatively in a part rotating in accordance with the reel spool 2, for example on the connecting part 11, on the rotating shaft 9 or possibly on the mantle of the reel spool 2, e.g. on the edge of the mantle. Also in this case, the part 10*c* which is in a supporting contact and the part which receives the loading, rotate with respect to each other via two rotating joints (the rotative mounting of the shaft 9 in the bearing housing, and the separate rotative mounting of the load-receiving part on a rotating part).

The invention is applicable especially in connection with a centre-drive assisted reeling, in which calendered paper, especially multi-roll calendered paper is reeled, the web having been driven through several calender nips. Such a multi-roll calender can be located before the reel-up in the same papermaking or finishing line for paper in an apparatus conveying the paper web to the reel-up, wherein the measurement of the properties from the web, especially the defining of the profile indicating the thickness, takes place after the calender in order to detect deviations in the calendered web.

What is claimed is:

1. Method for controlling the structure of a reel, in which method a continuous paper web (W) is reeled around a reel spool (2) to form a reel (R), and one or more variables are measured from the web (W), comprising the steps of:

calendering the paper web by a calender;

measuring one or more variables from a calendered paper web after the calender;

changing a lateral oscillation of the web when a particular, predetermined change occurs in the variable; and guiding the web to different locations in the reel (R) in the axial direction of the reel spool (2) by means of said change in said lateral oscillation.

2. Method according to claim 1, wherein an oscillation frequency is such that during one cycle, a web length of at least 100 m, is reeled on the reel.

3. Method according to claim 1, further comprising the step of:

starting oscillation in the lateral direction of the web when a particular, predetermined change occurs in the variable.

4. Method according to claim 1, further comprising the step of:

changing the oscillation in progress when a particular, predetermined change occurs in the variable.

5. Method according to claim 1, further comprising the steps of:

measuring the transverse profile of the web (W), and changing the oscillation by one of starting the oscillation and changing the oscillation in progress when a predetermined change occurs in the transverse profile.

6. Method according to claim 5, wherein the variable determining the oscillation is the maximum deviation of a variable over the entire width of the web (W) or within a predetermined area in the lateral direction of the web (W).

7. Method according to claim 5, wherein the variable is the statistical dispersion of a variable within the entire width of the web (W), or within a predetermined area in the lateral direction of the web (W).

8. Method according to claim 1, further comprising the step of:

adjusting the oscillation in accordance with the magnitude of the change of the variable.

9. Method according to claim 8, further comprising the step of:

adjusting the amplitude (L) of the oscillation in the oscillation.

10. Method according to claim 8, further comprising the step of:

adjusting the speed of the oscillation in the oscillation.

11. Method according to claim 1, wherein the oscillation is implemented by transferring the web (W) back and forth in a transverse direction relative to a web running direction by means of members (3) guiding the web (W), wherein said members (3) guiding the web are located before the reel-up.

12. Method according to claim 1, wherein the oscillation is implemented by moving the reel spool (2) accumulating the web (W) around itself in the reel-up back and forth in the axial direction.

13. Method according to claim 1, wherein the oscillation amplitude is a maximum of 100 mm.

14. Method according to claim 1, wherein an oscillation frequency is such that during one cycle, a web length of at least 200 m is reeled on the reel.

15. Method according to claim 1, wherein the oscillation amplitude is between 2 and 50 mm.

16. Apparatus for controlling the structure of a reel, comprising:

a reel-up arranged to reel a continuous paper web (W) around a reel spool (2) to form a reel, a calender arranged to calender the continuous paper web before the reel-up;

a measuring device (M) arranged after the calender and arranged to measure one or more variables from the web passing by, said measuring device being connected to a central processing unit (C) to process the measured information, wherein the central processing unit (C) is connected to actuators (A), said actuators (A) being structured and arranged to produce a relative oscillating motion of the web (W) with respect to the reel spool in the axial direction of the reel spool, wherein the central processing unit (C) is adapted to compare the measurement result transmitted by the measuring device (M) with one or more predetermined conditions and is adapted to transmit a command to the actuators (A) to change the oscillation, wherein said command to the actuators include starting of the oscillation or changing of the oscillation, when the measurement result fulfils certain predetermined conditions.

17. Apparatus according to claim 16, wherein the measuring device (M) is arranged to measure the transverse profile of the web (W) and the central processing unit (C) contains one or more predetermined conditions related to the transverse profile, wherein the predetermined conditions trigger the oscillation when they are fulfilled.

18. Apparatus according to claim 17, wherein one of the predetermined conditions related to the transverse profile is a maximum deviation of a variable within the entire width of the web (W) or within a predetermined area in the lateral direction of the web.

19. Apparatus according to claim 17, wherein one of the predetermined conditions related to the transverse profile is a statistical dispersion of a variable within the entire width of the web (W) or within a particular area in the lateral direction of the web (W).

20. Apparatus according to claim 16, wherein the central processing unit (C) is adapted to adjust the oscillation.

21. Apparatus according to claim 16, wherein the actuators (A) are in contact with members (3) guiding the web, wherein said members (3) are located before the reel-up, said members being arranged to move under the effect of the actuators back and forth along a particular path of motion, and to move the web (W) sideways within the scope determined by the path of motion.

22. Apparatus according to claim 16, wherein the actuators (A) are in contact with the reel spool (2) located in the reel-up, and wherein the actuators are arranged to move the reel spool (2) back and forth in the axial direction.

23. Apparatus according to claim 22, wherein the actuators (A) are arranged to move the reel spool (2) with respect to supporting structures (S) structured and arranged to support the reel.

24. Apparatus according to claim 23, further comprising:

a bearing housing (10) coupled to the end of the reel spool, said bearing housing comprising a stationary part **(10*a*) structured and arranged in supporting contact with the supporting structure such, and a moving part (10*b*) structured and arranged to move in the axial direction with respect to the stationary part (10*a*), in which moving part (10*b*) a rotating shaft (9) of the reel spool (2)** is structured and arranged to rotate.

25. Apparatus according to claim 16, wherein in the end of the reel spool (2), a part **(10*c*) which is in supporting contact with a supporting structure (S) is differentiated from the surface (14) which receives loading effecting a load in the reeling nip (N) between a reeling cylinder (1) and the reel (R), wherein said part (10*c*) and said surface (14) are adapted to move with respect to each other in the direction of rotation of the reel spool (2)**.

26. Apparatus according to claim 16, wherein the reel spool (2) has a drive of its own.

27. Apparatus according to claim 20, wherein the central processing unit (C) is adapted to adjust at least one of the amplitude (L) and speed of the oscillation in accordance with the measurement results.

28. Apparatus according to claim 23, wherein the supporting structures (S) are reeling rails or primary arms (7) of the initial reeling device.

* * * * *